US009833820B2

(12) United States Patent
Thieven

(10) Patent No.: US 9,833,820 B2
(45) Date of Patent: Dec. 5, 2017

(54) DEOXIDATION OF CROSS-ROLLED HOLLOW BLOCKS

(71) Applicant: SMS MEER GMBH, Mönchengladbach (DE)

(72) Inventor: Peter Thieven, Aachen (DE)

(73) Assignee: SMS MEER GMBH, Moenchengladbach (DE)

( * ) Notice: Subject to any disclaimer, the term of this patent is extended or adjusted under 35 U.S.C. 154(b) by 287 days.

(21) Appl. No.: 14/419,684

(22) PCT Filed: Aug. 29, 2013

(86) PCT No.: PCT/EP2013/067917
§ 371 (c)(1),
(2) Date: Feb. 25, 2015

(87) PCT Pub. No.: WO2014/048670
PCT Pub. Date: Apr. 3, 2014

(65) Prior Publication Data

US 2015/0196942 A1 Jul. 16, 2015

(30) Foreign Application Priority Data

Sep. 26, 2012 (DE) ..... 10 2012 019 025

(51) Int. Cl.
*B21B 19/04* (2006.01)
*B21B 45/00* (2006.01)
(Continued)

(52) U.S. Cl.
CPC ..... *B21B 19/04* (2013.01); *B21B 25/00* (2013.01); *B21B 45/00* (2013.01); *B21B 45/04* (2013.01); *B21B 23/00* (2013.01)

(58) Field of Classification Search
CPC B21B 9/00; B21B 15/00; B21B 19/04; B21B 23/00; B21B 25/00; B21B 45/00; B21B 45/04
See application file for complete search history.

(56) References Cited

U.S. PATENT DOCUMENTS 3,577,754 A 5/1971 Calmes
4,928,507 A 5/1990 Staat et al.
(Continued)

FOREIGN PATENT DOCUMENTS

CH 655516 B 4/1986
DE 102011012761 A 5/2012
(Continued)

*Primary Examiner* — Teresa M Ekiert
(74) *Attorney, Agent, or Firm* — Andrew Wilford

(57) ABSTRACT

The invention relates to a method for producing a tube (2) or tubular pre-product from a solid billet in a rolling mill, comprising at least one roll (5*a*, 5*b*) acting from the outside on the solid billet or tubular pre-product and a mandrel (4) carrying a piercing head (3) and engaging from the inside in the tube or tubular pre-product, wherein immediately after the solid billet has been completely pierced by the piercing head a fluidized deoxidation agent and/or an inert gas is supplied to the end of the tube or tubular pre-product facing the roll and is guided through the tube or tubular pre-product into the interior of the tube or tubular pre-product when the mandrel is withdrawn. The invention further relates to a rolling mill for performing the method according to the invention, comprising at least one roll acting from the outside onto the solid billet or tubular pre-product and a mandrel carrying a piercing head and engaging from the inside in the tube or tubular pre-product, wherein a device is provided for feeding and introducing a fluidized deoxidation agent and/or an inert gas to the end of the tube or tubular pre-product facing the at least one roll.

10 Claims, 1 Drawing Sheet

(51) Int. Cl.

| | |
|---|---|
| ***B21B 45/04*** | (2006.01) |
| ***B21B 25/00*** | (2006.01) |
| *B21B 23/00* | (2006.01) |

(56) References Cited

U.S. PATENT DOCUMENTS

| | | | |
|---|---|---|---|
| 2013/0091916 | A1 | 4/2013 | Peltoniemi |
| 2013/0098128 | A1 | 4/2013 | Pehle |

FOREIGN PATENT DOCUMENTS

| | | | |
|---|---|---|---|
| DE | 102011012761 | A1 | 5/2012 |
| GB | 2135336 | A | 8/1984 |
| JP | 59033011 | B | 2/1984 |
| WO | 2011083101 | A | 7/2011 |

Fig. 1 -- Prior Art
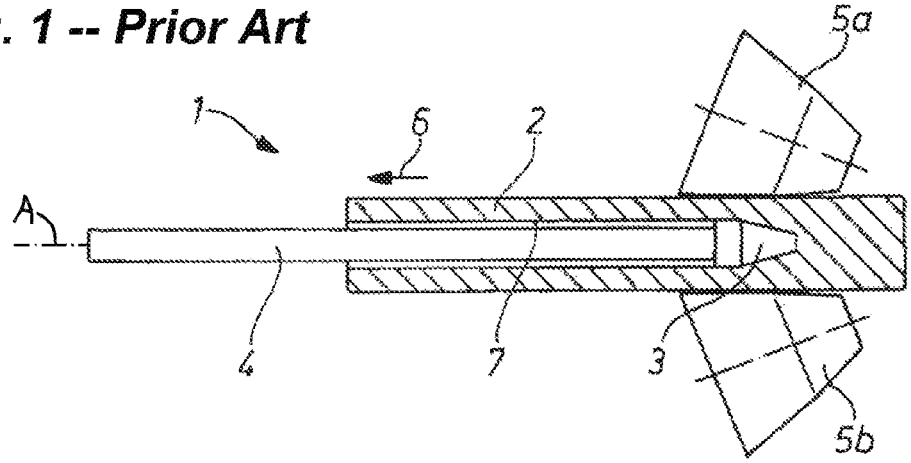
Fig. 2
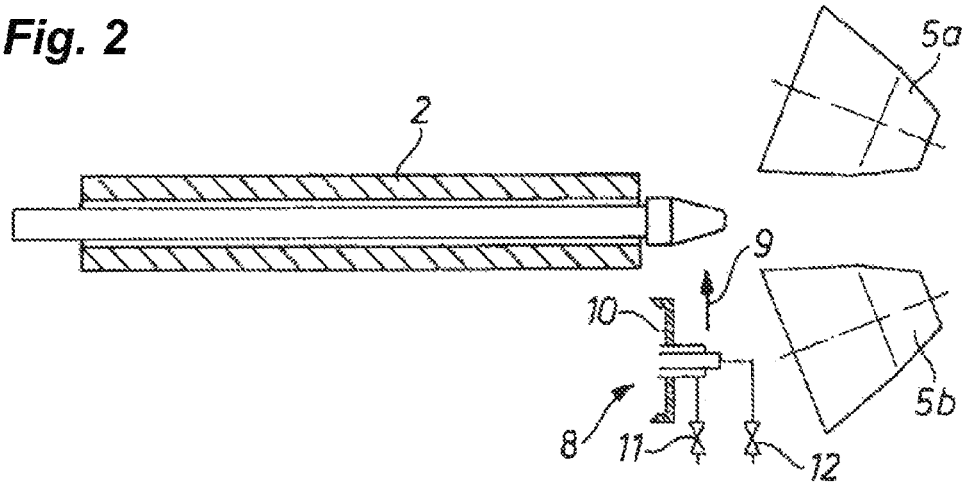
Fig. 3
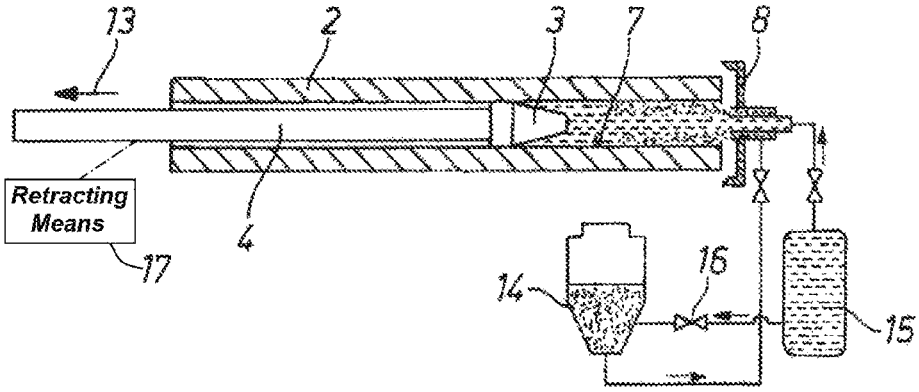

DEOXIDATION OF CROSS-ROLLED HOLLOW BLOCKS

CROSS REFERENCE TO RELATED APPLICATIONS

This application is the US-national stage of PCT application PCT/EP2013/067917 filed 29 Aug. 2013 and claiming the priority of German patent application 102012019025.5 itself filed 26 Sep. 2012.

FIELD OF THE INVENTION

The invention relates to a method of making a tube or a tubular preproduct from a solid billet by means of a rolling apparatus comprising at least one roll, in particular a cross-roll, acting from the outside on the solid billet or the tubular preproduct as well as a mandrel having a piercing head and engaging into the tube or tubular preproduct. In addition, the invention relates to a rolling apparatus for carrying out such a method.

PRIOR ART

The manufacture of hollow workpieces such as tubes or tubular preproducts from solid metal billets has been carried out for many decades by using the piercing mandrel process, with which those skilled in the art are adequately familiar and in which a piercing head is carried by a mandrel and, in a hot shaping process, a metallic solid billet is shaped continuously into a hollow block. In this shaping process, the workpiece is usually held between two cross-rolls acting from the outside and rotating the workpiece. The wall thickness of the hollow body is usually determined by the spacing between the piercing head and the external roll(s).

In this hot shaping process, mill scale, which can interfere with the shaping process itself and can also reduce the surface quality of the tube or tubular preproduct, occurs due to the surfaces that are formed during the shaping process and due to their contact with the atmosphere.

Therefore, an attempt is made, on the one hand, to limit the amount of scale formed to a minimum and, on the other hand, to remove whatever scale has nonetheless formed before the next finishing process steps. One approach for removing the mill scale is to use fluidized deoxidizing agents, for example, and to inject inert gases to protect at least the inner surface of the hollow block of the tube or tubular preproduct produced in this way. Such methods are described for example in DE 1427828 [U.S. Pat. No. 3,577,754], DE 3405771 [GB 2,135,336], CH 655516, and WO 2011/083101.

The deoxidizing agent is injected in a special deoxidization station downstream of the piercing roll equipment by coupling an injection device to one end of the hollow block and optionally a suction device to the other end of the hollow block. An alternative to this is suggested in WO 2011/154133 [US 2013/0091916] and DE 1427828 [U.S. Pat. No. 3,577,754], in which, during or immediately after the piercing, inert gas or a deoxidizing agent is injected into the hollow block through holes in the support rod of the piercing head or through holes in the piercing head itself.

Although this process option has not yet been tested adequately, a number of problems can be expected involving both the plant and the process management.

Injecting the deoxidizing agent in a separate deoxidization station requires large quantities of inert gas to first blow out the loose internal scale formed in the meantime and then to force the ambient air that has penetrated into the hollow block out of the hollow block and then to force out excess quantities of the deoxidizing agent because it is deposited preferentially in the front half of the hollow block. There is thus the problem that an unnecessarily large amount of deoxidizing agent must be used to process the entire length of the hollow block. Some of the excess deoxidizing agent gets out into the rolling plant, and some of it is burned with an intense flame.

The methods in which the deoxidizing agent is to be injected through the support rod during or shortly after the end of the piercing require a complex structure of the abutment in cross-rolling, the support rod of the piercing head or of the piercing head itself. In addition, there is the risk of blockage of the feeder line and the outlet channels by the deoxidizing agent, which is usually highly hygroscopic and has a tendency to clump, in particular also because the piercing head and the support rods are water cooled internally and/or externally.

OBJECT OF THE INVENTION

One object of the invention is therefore to provide a method and a device to improve the uniformity of application of the deoxidizing agent to the inner surface of the tube. In addition, the object of the invention is to limit the use of the amount of deoxidizing agent to the required minimum.

SUMMARY OF THE INVENTION

According to the invention, a fluidized deoxidizing agent and/or an inert gas is fed to the end of the tube or the tubular preproduct juxtaposed with the roll immediately after complete piercing of the solid billet by the piercing head, and then the fluidized deoxidizing agent and/or inert gas is fed into the interior of the tube or the tubular preproduct during retraction of the piercing mandrel through the tube or the tubular preproduct. This means that, as soon as the piercing head has passed completely through the solid billet and a continuous throughgoing passage is obtained in the hollow block, the tube or the tubular preproduct, inert gas, deoxidizing agent or a mixture thereof is fed to the front end of the tube or the tubular preproduct juxtaposed with the at least one roll, in particular the cross-roll, promptly, in particular within a period of 10 seconds after puncturing the solid billet, preferably within 5 seconds, especially preferably within 1 second after complete piercing of the solid billet and then the inert gas, deoxidizing agent or mixture thereof is fed into the interior of the tube or the tubular preproduct by the action of the subatmospheric pressure generated on retraction of the piercing mandrel through the tube or the tubular preproduct.

According to the invention, the subatmospheric pressure thus formed by retraction of the piercing mandrel in the hollow block is used to draw in the inert gas and/or a deoxidizing agent that has been fluidized by a support gas. The deoxidizing agent and optionally also the inert gas are fed through one of the ends of the hollow block.

This not only makes it possible for contact of the newly formed inner surface of the tube with atmospheric oxygen to be limited to the required minimum, but also, the supply of deoxidizing agent and/or inert gas under the influence of the subatmospheric pressure created in retraction of the piercing mandrel requires that a smaller amount of deoxidizing agent and/or inert gas be consumed, based on immediate coverage of the inner surface of the hollow block after the piercing and a turbulence created in the deoxidizing agent and/or inert gas as well as a distribution in the hollow block without excess quantities of support gas, inert gas and/or deoxidizing agent that would otherwise be necessary in most cases.

A device according to the invention for supplying and introducing fluidized deoxidizing agent and/or inert gas into the end of the tube or the tubular preproduct juxtaposed with at least one of the rolls is provided for this purpose. The effects that can be achieved with the device are the same as those already described above with respect to the method.

In a preferred embodiment of the invention, the feeding of fluidized deoxidizing agent and/or inert gas starts already before the piercing mandrel is retracted so as to thus ensure that no ambient air but instead only inert gas, deoxidizing agent or a mixture thereof is fed into the interior of the hollow block by a subatmospheric pressure created by the retraction of the piercing mandrel.

It is preferred in particular if a process control starts the retraction of the piercing mandrel and the feed of fluidized deoxidizing agent and/or inert gas simultaneously to thereby limit the consumption of inert gas and/or deoxidizing agent to the required minimum.

It is also preferred if the inflow of air into the interior of the tube or the tubular preproduct is at least largely suppressed until the start of the feeding of the fluidized deoxidizing agent and/or inert gas. For example, by introducing inert gas through the end of the workpiece remote from the roll, in particular the cross-roll, this can already be achieved during the mandrel-piercing mandrel that is not yet concluded.

According to a preferred embodiment of the invention, the fluidized deoxidizing agent and/or inert gas is fed at a superatmospheric pressure of no more than 1 bar, preferably no more than 0.25 bar. Only the feeding of fluidized deoxidizing agent and/or inert gas is advantageously supported in this way, but the introduction and distribution of deoxidizing agent and/or inert gas within the hollow block are achieved mostly through the subatmospheric pressure created by the piercing head.

Since the piercing head is usually only slightly smaller than the inside diameter of the hollow block, a subatmospheric pressure is formed to the rear of the piercing head remote from its support during retraction of the piercing head, and thus also on the side of the piercing head juxtaposed with the roller. Because of this subatmospheric pressure, the suction effect is utilized to draw inert gas and/or fluidized deoxidizing agent into the hollow block itself. Inert gas and/or deoxidizing agent and a more uniform distribution of the later in the hollow block are therefore to be expected here because the media injected need not first overcome the resistance of an air mass present in the hollow block, and a strong turbulence is created by the suction effect of the piercing head. Furthermore, inert gas and/or deoxidizing agent is/are fed with a steady increase in the space available inside the hollow block, so there is also no return flow of the media stream due to the sudden expansion of the gaseous media in contact with the hot interior of the hollow block, as is occasionally observed in practice.

It is preferable if a vehicle gas is mixed with the deoxidizing agent. This supports the supply and distribution of deoxidizing agent to the workpiece and within the hollow block in a particularly advantageous manner. In particular, fluidization of the deoxidizing agent by mixing with a gaseous medium can be achieved with the vehicle gas.

It is also preferable if the deoxidizing agent is fed pneumatically. In this way, a particularly simple and controllable method is used for feeding the deoxidizing agent to the workpiece with pressures that are particularly easily and accurately adjustable.

According to a second aspect of the invention, as already described in the introduction, a rolling apparatus is disclosed for carrying out the method according to the invention in the first aspect of the invention. The rolling apparatus comprises at least one roll acting from the outside on the solid billet or the tubular preproduct, in particular the cross-roll as well as a mandrel bar having a piercing head and engaging in the tube or tubular preproduct from the inside. A device for supplying and introducing fluidized deoxidizing agent and/or inert gas is provided, preferably comprising means for sealing the tube or the tubular preproduct on at least one end with respect to the ambient atmosphere. Such means can for example be a cover that completely blocks the continuous opening created by the piercing head.

In another preferred embodiment of the invention, a supply for an inert gas and a supply for a deoxidizing agent as well as valves for controlling the feeding from of the respective supplies to the tube or tubular preproduct are provided.

It is especially preferable in this context if a process control unit is provided for controlling the supply of deoxidizing agent and/or inert gas as well as for controlling the piercing head. Due to this process control unit, the supply of inert gas and/or the oxidizing agent on the movement of the piercing head can be coordinated, so that a reliable process management with optimized quantity supply of inert gas and/or deoxidizing agent can be achieved, depending on the given factors of the process.

BRIEF DESCRIPTION OF THE DRAWINGS

The invention is described in greater detail below with reference to three figures in which:

FIG. 1 is a schematic view of the method of making a tube or tubular preproduct from a solid billet using a prior-art rolling apparatus, FIG. 2 is a schematic view of a rolling apparatus before the start of the method according to the invention, and FIG. 3 is a schematic view of an inventive rolling apparatus when carrying out the method according to the invention.

DETAILED DESCRIPTION OF THE INVENTION

FIG. 1 shows a schematic view of a rolling apparatus 1 for piercing a workpiece 2 using a mandrel rod 4 carrying a piercing head 3. Two external cross-rolls 5*a* and 5*b* rotate the workpiece 2 and at the same time move it in the direction of the arrow 6 to thereby continuously form a tube 2 or tubular preproduct having an inner surface 7 newly created by the piercing head 3 from a solid metal block.

FIG. 2 shows a schematic view of a rolling apparatus 1 according to the invention in which a device 8 for supplying deoxidizing agent and inert gas is provided on the end of the tube 2 at the rolls 5*a* and 5*b*. The piercing head 3 has just advanced completely through the workpiece 2 and the device 8 is shifted in the direction indicated by the arrow 9. The device 8 comprises a cover 10 for closing the end of the tube 2 juxtaposed with the rolls as well as valves 11 and 12 for supplying deoxidizing agent and inert gas through the device 8 into the tube 2.

Finally, FIG. 3 shows the rolling apparatus 1 while carrying out the method according to the invention. As the piercing head 3 together with the mandrel rod 4 is being extracted out of the tube 2 in the direction of arrow 13 by a retracting means shown schematically at 17, a deoxidizing agent and nitrogen as the inert gas are fed into the tube 2 through the device 8 from the respective supplies 14 and 15 and in fed into the internal cavity of the tube 2 formed by the mandrel rod 4 and onto its inside wall 7, where it is fluidized. The device 8 also comprises a valve 16 through which nitrogen is fed from the supply 15 into the supply 14 for deoxidizing powder in such a way as to fluidize the deoxidizing powder with the nitrogen from the supply 15. In this preferred embodiment, nitrogen from the supply 15 thus also serves as a vehicle gas for the deoxidizing powder from the supply 14.

The invention claimed is:

1. A method of making a tube from a solid billet extending along an axis, the method comprising the steps of sequentially:

engaging a piercing head of a mandrel into a rear end of the solid billet while rotating the billet about the axis with at least one roller engaging a front end of the billet so as to push the piercing head forward through the billet and form an axially throughgoing passage in the billet until the piercing head exits the front end of the billet, whereby the solid billet is formed into a tube;

after the piercing head exits from the front end of the tube feeding into the passage at the front end a fluidized deoxidizing agent and/or an inert gas;

retracting the piercing head axially rearward in the passage so as to depressurize the passage between the piercing head and the front end and draw in the fluidized deoxidizing agent and/or the inert gas; and mixing a vehicle gas with the deoxidizing agent.

2. The method according to claim 1, wherein the feeding of the fluidized deoxidizing agent and/or inert gas begins before retraction of the piercing mandrel.

3. The method according to claim 1, wherein the feeding of fluidized deoxidizing agent and/or an inert gas takes place within 10 seconds after completely piercing the solid billet.

4. A method of making a tube from a solid billet extending along an axis, the method comprising the steps of sequentially:

engaging a piercing head of a mandrel into a rear end of the solid billet while rotating the billet about the axis with at least one roller engaging a front end of the billet so as to push the piercing head forward through the billet and form an axially throughgoing passage in the billet until the piercing head exits the front end of the billet, whereby the solid billet is formed into a tube; and thereafter by a process controller starting feeding into the passage at the front end a fluidized deoxidizing agent and/or an inert gas while simultaneously retracting the piercing head axially rearward in the passage so as to simultaneously depressurize the passage between the piercing head and the front end and draw in the fluidized deoxidizing agent and/or the inert gas.

5. The method according to claim 4, further comprising the step of:

blocking entry of air into the passage of the tube at least mostly, at least at the start of the feeding of fluidized deoxidizing agent and/or inert gas.

6. The method according to claim 4, wherein the fluidized deoxidizing agent and/or inert gas is fed at a superatmospheric pressure of no more than 1 bar.

7. The method according to claim 4, wherein the deoxidizing agent is fed pneumatically.

8. An apparatus for making a tube from a solid billet extending along an axis, the apparatus comprising:

a mandrel carrying a piercing head displaceable along the axis;

at least one cross roller engageable with a front end of the solid billet for rotating the solid billet while engaging the piercing head into a rear end of the solid billet so as to push the piercing head forward through the billet and form an axially throughgoing passage in the billet until the piercing head exits the front end of the billet, whereby the solid billet is formed into a tube;

a supply including a first supply of an inert gas, a second supply of a deoxidizing agent, and valves connected to the first and second supplies for creating a fluidized deoxidizing agent and feeding the fluidized deoxidizing agent into the passage at the front; and a retracting device configured to retract the piercing head axially rearward in the passage so as to depressurize the passage between the piercing head and the front end and draw in the fluidized deoxidizing agent.

9. The method according to claim 1, further comprising the step of:

sealing the tube on at least one end with respect to the ambient atmosphere.

10. The rolling apparatus according to claim 8, further comprising:

a process control unit for controlling feeding of agent and/or inert gas and for controlling the piercing head.

* * * * *